US010590619B2

(12) United States Patent
Ronnkvist

(10) Patent No.: US 10,590,619 B2
(45) Date of Patent: Mar. 17, 2020

(54) HELICAL PIER WITH THICKENED HEXAGONAL COUPLING ENDS AND METHOD OF MANUFACTURE

(71) Applicant: Thomas M. Ronnkvist, Mound, MN (US)

(72) Inventor: Thomas M. Ronnkvist, Mound, MN (US)

( * ) Notice: Subject to any disclaimer, the term of this patent is extended or adjusted under 35 U.S.C. 154(b) by 0 days.

(21) Appl. No.: 16/372,267

(22) Filed: Apr. 1, 2019

(65) Prior Publication Data

US 2019/0301126 A1 Oct. 3, 2019

Related U.S. Application Data

(60) Provisional application No. 62/792,286, filed on Jan. 14, 2019, provisional application No. 62/753,219, filed on Oct. 31, 2018, provisional application No. 62/651,955, filed on Apr. 3, 2018.

(51) Int. Cl.

| | |
|---|---|
| ***E02D 5/56*** | (2006.01) |
| ***E02D 7/02*** | (2006.01) |
| ***B21K 1/06*** | (2006.01) |

(52) U.S. Cl.

CPC ..... *E02D 7/02* (2013.01); *B21K 1/06* (2013.01); *E02D 5/56* (2013.01); *E02D 2250/00* (2013.01); *E02D 2300/0029* (2013.01)

(58) Field of Classification Search

CPC ..... E02D 5/523; E02D 5/526; E02D 5/56
USPC ..... 405/241, 244, 251, 252.1; 248/530; 52/157, 165

See application file for complete search history.

(56) References Cited

U.S. PATENT DOCUMENTS

| | | | | |
|---|---|---|---|---|
| 3,512,366 | A | 5/1970 | Turzillo | |
| 4,009,582 | A | 3/1977 | LeCorgne | |
| 5,575,593 | A | 11/1996 | Raaf | |
| 7,510,350 | B2 | 3/2009 | Ronnkvist | |
| 7,748,932 | B2 | 7/2010 | Lindsey | |
| 8,079,781 | B2 | 12/2011 | Ronnkvist | |
| 8,777,520 | B2 | 7/2014 | Lin | |
| 2003/0041535 | A1 * | 3/2003 | Rupiper | E02D 5/801 52/165 |

(Continued)

FOREIGN PATENT DOCUMENTS

JP 2011-32783 A * 2/2011

*Primary Examiner* — Sunil Singh

(74) *Attorney, Agent, or Firm* — Schroeder & Siegfried, P.A.

(57) ABSTRACT

A helical pier and extension shaft, one end of which is formed with a thickened hexagonally shaped female end coupler using a hot forging process that swedges and compresses the walls of the female coupler into a thickened hexagonal configuration, with subsequent heat treatment to recover and enhance yield and tensile strength to the entire main body section and female end coupler of the helical pier and extension shafts. A corresponding hexagonally shaped male coupler may be milled and inertia friction welded to the opposite end of each extension shaft, or alternatively hot forged and internally upset as an integral homogeneous part of each extension shaft, thereby completing construction of the extension shaft with opposing corresponding male and female hexagonal couplers. The forgoing helical pier has particular benefits in applications requiring deep soil penetration and/or when using a grouted helical pier system.

19 Claims, 11 Drawing Sheets

(56) References Cited

U.S. PATENT DOCUMENTS

2009/0180838 A1* 7/2009 Ronnkvist ..... E02D 5/801
405/251

* cited by examiner

HELICAL PIER WITH THICKENED HEXAGONAL COUPLING ENDS AND METHOD OF MANUFACTURE

CROSS REFERENCE TO RELATED APPLICATIONS

This application is a nonprovisional application which claims the benefit of U.S. Provisional Patent Application Ser. No. 62/651,955, filed on Apr. 3, 2018, Provisional Patent Application Ser. No. 62/753,219, filed on Oct. 31, 2018, and Provisional Patent Application Ser. No. 62/792,286, filed on Jan. 14, 2019, the contents of each application of which is hereby incorporated by reference herein in its entirety.

FIELD OF INVENTION

The present invention relates generally to the field of structural pier devices utilized as footings or structural supports for walls, platforms, towers, bridges, building foundations and the like, and more specifically to the improved construction of a helical pier utilized for such purposes.

BACKGROUND OF INVENTION

The foundations of many structures, including residential homes, commercial buildings, bridges, and the like, have heretofore conventionally been constructed of concrete slabs, caissons and footings upon which the foundations walls rest. These footings, which are typically constructed of poured concrete, may or may not be in contact with a stable load-bearing underground soil structure, and the stability of the foundation walls, and ultimately the entire structure being supported, depends on the stability of the underlying soil against which the footings bear.

Oftentimes the stability of the soil, particularly near ground surface, can be unpredictable. Changing conditions over time can dramatically affect the stability of the underlying soil, thereby causing a foundation to move or settle. Such settling can cause cracking and other serious damage to the foundation walls, resulting in undesirable shifting of the supported structure, and consequent damage to windows, doors and the like. This ultimately affects the value of the building and property upon which the building is situated.

In some situations, it has been found that the soil may simply be too unstable to cost effectively utilize concrete footings as the foundation for new construction. In other situations, existing concrete foundation walls have settled, causing damage and requiring repair. In still other situations, such as in some foreign markets, the shortage of concrete and abundance of residential and commercial construction has limited the use of poured concrete footings altogether. All of the above has led to the development and advent of the screw-in helical pier, which is the subject of the present invention.

The use of such screw-in helical piers have become increasingly common for use as footings or underpinnings in new building construction, as well as for use in the repair of settled and damaged footings and foundations of existing buildings and other structures. Typically, in new construction, a plurality of such helical piers are strategically positioned and hydraulically screwed into the ground to a desired depth where the underground stratum is sufficiently stable to support the desired structure. This generally involves screwing the helical pier to bedrock or screwing the pier into consolidated material until a calculated rotational resistance is found. Once in place, the piers are tied together and all interconnected by settling them within reinforced concrete. In a similar manner, such helical piers are often positioned along portions of settling and damaged foundation walls of a structure, and utilized to repair the structure by lifting and supporting the settling foundation.

Exemplary systems utilizing helical piers or underpinnings of this type can be found in U.S. Pat. Nos. 8,777,520; 7,510,350; 5,011,336; 5,120,163; 5,139,368; 5,171,107; 5,213,448; 5,482,407; 5,575,593; and 6,659,692. The helical piers in these systems will typically include at least one helical plate or flight welded to a drive shaft or column. The shaft and helical flights are generally constructed of a non-corrosive material, such as galvanized steel, to prevent deterioration of the pier over time. Typically, the steel utilized will be a commercially available grade of about 0.18% carbon by weight, with a yield and tensile strength in the range of about 40,000-55,000 psi.

By way of example, and depending on the application, a standard round shaft starter section may consist of a round hollow hot or cold rolled welded, or seamless, steel tubular shaft 2⅞" thru 7.0" O.D. typical, with one or more steel helical flights or plates of 6"-20" in diameter welded at spaced intervals thereto. The helical flights typically range in diameter with the smaller diameter flight nearer the bottom of the drive shaft to ensure that the load-bearing surface of each helix partially contacts undisturbed soil upon insertion into the ground. The pitch of the steel flights may range from 3"-6", and the starter section will have a pointed lower tip, such as by cutting the tip at a 45 degree angle.

Depending upon the application and depth required for reaching bedrock or other suitably stable strata to support the intended structure, multiple extension shafts also formed of hot or cold rolled steel, which may or may not include additional helical flighting, may be coupled to the starter shaft and each other, as needed. Heretofore, such coupling has been accomplished with the use of separate tubular coupling inserts having an outer diameter slightly smaller than the inside diameter of the extension and starter sections. Others have swelled one end of a shaft through hot or cold forging to form a female coupler portion for receiving an adjoining shaft. Still others have either hand welded or inertia friction welded end coupler portions to the extension and starter sections.

Such coupler inserts/ends are pre-drilled with multiple bolt holes that align with corresponding bolt holes in the adjoining ends of the starter and extension shafts. Bolts received through the aligned openings of the shafts and coupling sections act to secure the adjoining sections together. Heretofore, such coupling joints have represented common areas of weakness. It has been found that the greater torque generated at increased depths of installation causes coupling failures between the adjoining shaft sections. At or near the coupling joints, the pre-drilled holes in the shafts and inserts begin to tear laterally under excessive applied drive torque, thereby loosening and weakening the bolted joints, and ultimately causing catastrophic failure many feet below ground level. This is particularly true where the walls of the shafts are swelled and consequently thinned to form coupling ends. In other instances, excessive torque will lead to failure of the welded shaft joints themselves, which also begin to split, thus causing further failure and weakening of the anchoring system.

In grouted pier systems, where grout is pumped through the center and out the sides of a helical pier to further strengthen the surrounding soil, even greater torque may be experienced. This can increase the load requirements even further, thus exacerbating an already vulnerable and weakened system. Such failures at the coupling joints of the helical piers can result in costly and time consuming repairs in the field.

It is therefore evident that there is a distinct need for an improved means of coupling the drive shafts sections of helical piers so as to withstand the significant forces exerted on such coupling devices in applications requiring increased load-bearing capacities and consequent increased drive torque for installation. It is with this object in mind that I have developed a helical pier with extension shafts having improved strength and durability, and coupler end portions capable of withstanding increased torque under applications requiring significant load-bearing capacity.

SUMMARY OF INVENTION

In one embodiment of the present invention, the main drive shaft of the helical pier starter section is machine fabricated in a manner similar to a conventional helical pier, with the exception that the upper end portion of the shaft is hot forged and compressed into a thickened, hexagonally shaped female coupler. In this regard, the main section of the drive shaft is cylindrical in cross section and constructed of galvanized steel throughout, preferably with a carbon composition in excess of approximately 0.25% by weight. The female end coupler section of the drive shaft is formed through a hot forging process, whereby the upper end portion of the drive shaft is heated and swedged outwardly to form a homogeneous integral female coupler having a hexagonal interior cross-sectional configuration. Formation of this female coupling section of the drive shaft homogeneously from the same pipe stock and in an out-of-round hexagonal shape substantially strengthens the coupling joint by causing applied torque to the shaft to be transmitted through the entire body of the coupler, rather than merely through the immediate area surrounding the connecting bolts, as with conventional cylindrical coupling joints.

While this alone helps to strengthen the coupling joint, significant additional strengthening of the coupling joint is also achieved through integrated formation and compression techniques used during the forging process of the female end coupler. By utilizing a hot forging process to form the female end coupler, the coupler is integrally formed from the same contiguous section of material as the original drive shaft, thus minimizing the potential for splitting or cracking often associated with hand welded joints. Furthermore, during the hot forging process, as the upper end of the drive shaft is swedged outwardly into a hexagonal cross section, it is also compressed, thereby causing a thickening of the wall structure at the female end coupler section. Consequently, the resulting hot forged, female end coupler is physically larger with an increased integral wall thickness that adds more mass and torque capacity, thus making it is substantially stronger than conventional hot or cold forged pipe couplings formed merely by swelling the ends of the pipe.

As with conventional pier structures, the entire body section of the starter drive shaft is initially heat treated, but much of the initial yield and tensile strength diminishes during the process of hot forging the female end coupler. Therefore, to further enhance the strength and durability of the helical pier well beyond that of any conventional pier device, upon completion of the hot forging process, the entire body section and integral female coupler is subjected to an additional heat treatment process which effectively increases the yield and tensile strength thereof to meet or exceed preferably 95,000 psi.

In accordance with the present invention, additional extension shafts having opposite complimentary male and female end coupler sections are also provided. Such extension shafts may be constructed of a similar material and heat treated in the same manner as described for the starter drive shaft above. In this regard, the main body section of the extension shaft is cylindrical in cross section and constructed of galvanized steel throughout, preferably with a carbon composition in excess of approximately 0.25% by weight. Each extension shaft is constructed with a female coupler section at one end and an associated male coupler section at the other end. The female coupler section of each extension shaft is formed in the same manner as with the starter section of the helical pier, i.e., hot forged and compressed to have an increased integral wall thickness that is substantially stronger than conventional hot or cold forged pipe couplings formed merely by swelling the pipe ends. Here again, the entire body section and integral female coupler of the extension shaft is heat treated subsequent to the hot forging process to a yield and tensile strength which meets or exceeds preferably 95,000 psi.

For the male coupler section, in one embodiment, it is contemplated that it could be formed as a milled hollow tubular element. With this embodiment, at least a portion of the tubular element would be milled with a hexagonal outer configuration designed to mate with the female end coupler of an adjoining starter section or extension shaft. The milled hexagonal male coupler section would preferably be constructed from heavy wall mild steel tubing or mild steel bar. The outer diametrical dimensions of the male hexagonal end coupler would be designed to be just slightly less than the corresponding inner dimensions of the mating female coupler section. This allows the male end coupler of any extension shaft to be telescopically inserted within the corresponding female coupler sections carried by the starter drive shaft or other extension shafts. The male coupler section of this embodiment could be inertia friction welded to the opposite end of the extension shaft as the hot forged female coupler, such that the main body section and male coupler section of the extension shaft become integrally fused together as a single unit.

By hot forging with compression and heat treating the female hex coupler from the body of each extension shaft, and subsequently inertia friction welding a male hex coupler thereto, a stronger coupling joint can be manufactured through a simplified process. By implementing such hot forging/compression techniques during production, the overall manufacturing process is simplified, requiring only a single inertia friction welding operation to attach the male coupler and complete the process. Most conventional helical piers and extension shafts having out-of-round coupling sections are either cold forged, resulting in thinner, weaker coupling joints, or hand welded in order to attach a thicker female coupler with stronger wall sections. Thus, heretofore, either strength and durability was compromised in the interest of production efficiency, or production efficiency was compromised in the interest of obtaining stronger and more durable coupling joints. Such compromises are not necessary using the present methods of manufacturing.

As an alternative, rather than inertia friction welding the male coupler section to the extension shaft, it is contemplated that similar hot forging techniques as described above could be used to form the male coupler homogeneously with the rest of the extension shaft. In this case, both the male and female coupler sections would be integrally formed with the main body section of the extension shaft as a single homogeneous structure, i.e., no welds. To accomplish this, the male coupler section is forged and internally upset to provide a hexagonal outer configuration that will mate with the inner hexagonal configuration of a corresponding female coupler section of an adjoining starter section or extension shaft. Through this process of hot forging and compression, the walls of both the male and female coupler sections will become thickened relative to the main body section, thereby increasing the overall strength of the extension shaft. Here again, the entire extension shaft, including the body section, and the integral male and female coupler sections, may be heat treated subsequent to the hot forging process to a yield and tensile strength which meets or exceeds preferably 95,000 psi.

This alternative manufacturing process of hot forging both the female and male hexagonal coupler sections to the extension shaft also provides benefits of a stronger coupling joint using a simplified process. By utilizing such hot forging/compression techniques to form the female and male hex coupler sections, a significantly stronger homogeneous coupling joint can be formed through a greatly simplified process. With this process, no added welding operations are required, thus simplifying the manufacturing process and creating an integral joint with no possibility of a weld breakage. Also, by using this process, the pier sections can be made with lighter wall tubes which are full length heat treated for higher load capacity at a lower price.

Of course, it is certainly conceivable that the starter section of the helical pier could also be configured with a male hexagonal coupler section, rather than a female coupler section, as described previously. Such a male hexagonal coupler section could be milled as a separate unit and inertia friction welded directly to the upper end of the starter section drive shaft, or alternatively, it could be formed integrally therewith in the manner described above by hot forging and internally upsetting the upper terminal end of the starter section drive shaft. Similar to its counterpart female coupler section, formation of this male coupler section of the drive shaft in an out-of-round hexagonal shape substantially strengthens the coupling joint by causing applied torque to the shaft to be transmitted through the entire body of the coupler. In this case, any extension shaft would simply be reversed to permit the hexagonal female coupling section thereof to mate with the terminal hexagonal male coupling section of the starter section. Preferably, each extension shaft, including the integral female coupling section thereof, is constructed from hot-finished seamless steel tubing to increase the strength of the pipe, and is fully galvanized to prevent corrosion and consequent deterioration of the pier.

In order to facilitate the attachment of a torque driving apparatus, or additional extension shafts, at least one set of opposing hexagonal faces of the female coupler includes pre-drilled holes extending transversely through its wall from the exterior to the interior of the coupler. Similar to the female coupler section, the male hexagonal coupler section of each extension shaft has corresponding pre-drilled tapped holes extending through the walls of at least one set of opposing hexagonal faces thereof which are configured and positioned to align with the holes of the female coupler sections to facilitate securement therebetween. Bolts received through the openings of the female coupler sections may be threaded into the aligned tapped holes of the male coupler to secure the adjoining shafts together.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF INVENTION

Figure 1:
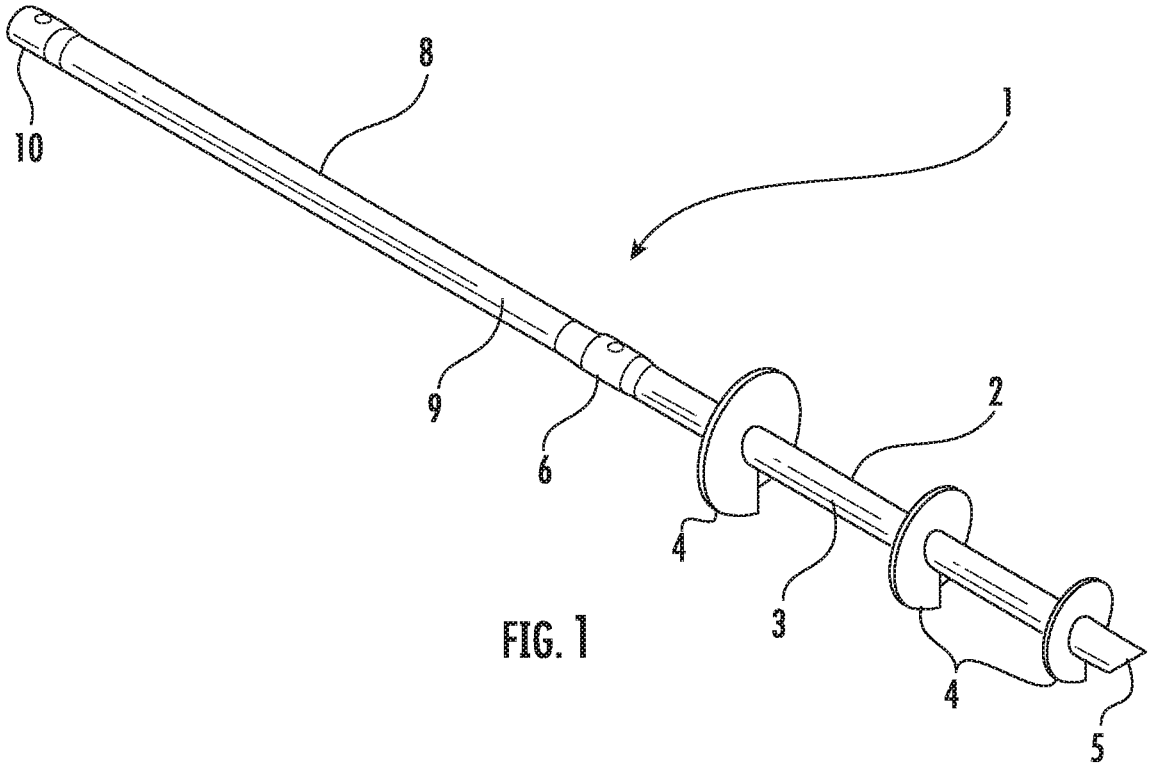
FIG. 1 is a perspective view of a helical pier constructed in accordance with the present invention, showing a starter pier section with an extension shaft connected thereto.
Figure 2:
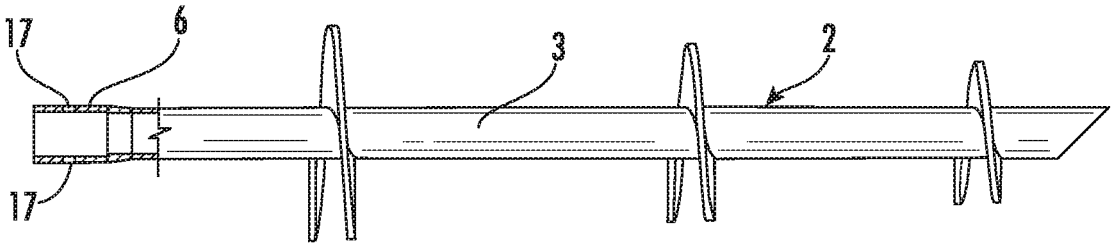
FIG. 2 is a side elevational view of the starter section of the helical pier shown in FIG. 1, showing the hot forged integral hexagonal female coupler section formed on one end thereof, with a portion broken away to show the interior construction thereof.

As shown in FIG. 1, in accordance with the present invention, a structural anchoring device in the form of a helical pier 1 is shown. Generally speaking, such a helical pier 1 includes a starter section 2, and one or more extension shafts 8. The lower starter section 2 of helical pier 1 is comprised of a main tubular drive shaft section 3 to which one or more helical plates 4 are secured, as by welding. The lower end of drive shaft 3 tapers to a point 5 to facilitate penetration of the ground upon insertion of the pier. Point 5 may take the form of and be constructed in any of a variety of ways, but in the preferred embodiment shown in FIG. 1, it is formed by cutting the lower end of the drive shaft 3 at a 45 degree angle, and leaving the end hollow.

Flights 4 are helically shaped to cause pier 1 to be screwed into the ground upon rotation of drive shaft 3. Each flight 4 secured to the main drive shaft 3 increases in diameter as the distance from point 5 increases. As shown in FIG. 1, and as a general rule, the helical flights 4 are typically spaced along drive shaft 3 at intervals of about three (3) times the diameter of the next lower flight. Although the thickness of flights 4 may vary depending on the size of the flight and the application involved, as shown in FIG. 1, such flights are approximately ⅜" thick.

The main tubular body portion of helical pier 1 and flights 4 welded thereto are constructed of galvanized hardened alloy steel to prevent corrosive deterioration of the pier over time. The main drive shaft section 3 is preferably constructed from hot-finished normalized seamless alloy steel tubing, so as to eliminate the possibility of any cracking or rupturing of the longitudinal weld associated with conventional welded hot or cold rolled tubing. In the preferred embodiment, the main drive shaft section 3 and flights 4 are constructed of normalized alloy steel having a carbon composition preferably in excess of approximately 0.25% by weight.

As seen best in FIGS. 1-3B, in accordance with the present invention, the upper end portion of the main drive shaft 3 of the helical pier starter section 2 is formed into an integral female coupler 6 using a process of hot forging. As shown best in Section A-A of FIG. 3B, during the hot forging process, the upper end portion of the drive shaft 3 is heated and swedged outwardly to cause the female coupler 6 to be shaped with an interior cross-sectional configuration of a hexagon. During this process, the exterior of the coupler section 6 is swelled outwardly to a larger diameter, but maintains its cylindrical configuration.

Formation of the female coupler section 6 of the drive shaft 3 with an out-of-round interior hexagonal configuration substantially strengthens the overall coupling joint by causing applied torque thereto to be transmitted through the entire body of the coupler 6, as opposed to conventional cylindrical couplings where the torque is transmitted primarily to the immediate area surrounding the connecting bolts. Moreover, by utilizing a hot forging process to form the female end coupler 6, the coupler is integrally formed from the same contiguous section of material as the original drive shaft 3, thus minimizing the potential for splitting or cracking often associated with hand welded joints, and providing additional strength and durability to the coupling joint as a whole.

Figure 3A:
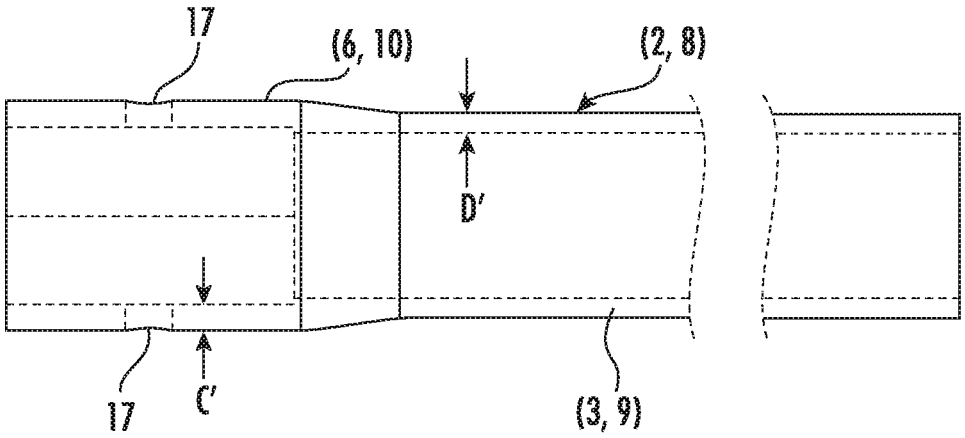
FIG. 3A is a close-up vertically sectioned view of the hot forged integral hexagonal female coupler section formed on the end of the starter section and extension shaft of a helical pier as shown in FIG. 1.
Figure 3B:
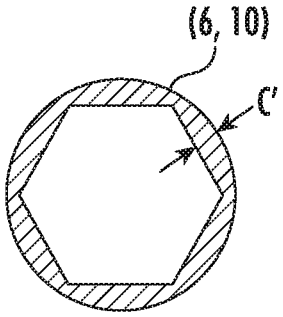
FIG. 3B is an end view of the hot forged female coupler section shown in FIG. 3A, showing the hexagonal configuration of the inner surface thereof.

Additional strengthening of the coupling joint is also achieved through compression of the female end coupler 6 during the hot forging process. As the upper end of the drive shaft 3 is swedged outwardly into a hexagonal interior cross section, the coupler section 6 is compressed axially, thereby causing a thickening of the wall section of the end coupler portion. This is best seen in FIG. 3B, where it is shown that a major portion the wall thickness C' of coupler 6 (at least along most of the six interior sides) is thicker than the wall thickness D' of the main drive shaft 3. In one embodiment, it is contemplated that the greater wall thickness of the coupler section 6 at C' is about 0.430 inches, as compared to a wall thickness D' of about 0.276 inches for the remainder of drive shaft 3. Consequently, the resulting hot forged, female end coupler 6 is physically larger with an increased integral wall thickness that adds more mass and torque capacity, thus making it substantially stronger than conventional hot or cold forged pipe couplings formed merely by swelling the ends of the pipe.

Although the main drive shaft 3 of the helical anchor 1 undergoes an initial heat treatment process to increase its yield and tensile strength to about 80,000 psi, much of this strength dissipates and is lost during the process of hot forging the female end coupler 6. Therefore, to further enhance the strength and durability of the helical pier 1 well beyond that of any conventional pier device, after the hot forging process is complete, the entire main drive shaft section 3 and integral female coupler 6 is subjected to an additional heat treatment process which effectively increases the yield and tensile strength thereof to meet or exceed preferably 95,000 psi. Once this heat treatment process is complete, the helical plates 4 are welded to the main drive shaft 3 to complete the starter section 2 of the helical pier 1.

As shown best in FIG. 1, one or more extension shafts 8 are often utilized in conjunction with the starter section 2 of helical pier 1 for applications requiring deeper penetration underground. As depths of installation increase to reach more stable strata for better load-bearing capabilities, consequently, so does the required drive torque for installation. For this reason, each of the additional extension shafts 8 are constructed of a similar material and heat treated in the same manner as the starter section 2 above. In this regard, the main tubular body section 9 of the extension shaft 8 is cylindrical in cross section and constructed of galvanized steel throughout, preferably from hot-finished normalized seamless alloy steel tubing, with a carbon composition in excess of approximately 0.25% by weight.

Figure 4:
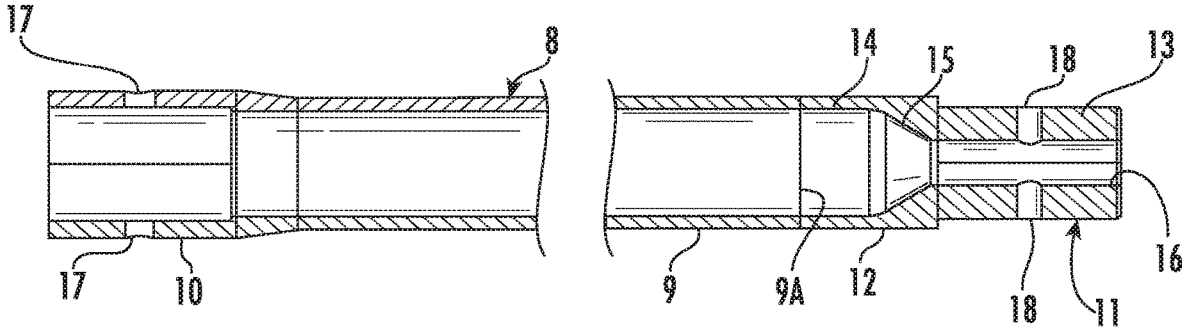
FIG. 4 is a vertically sectioned side elavational view of the extension shaft of the helical pier shown in FIG. 1, showing the hot forged integral hexagonal female coupler section formed on one end thereof and an integral milled hexagonal male coupler section inertia friction welded to the opposite end.

As shown best in FIG. 4, each extension shaft 8 is constructed with a hexagonal female coupler section 10 at one end and a corresponding hexagonally shaped male coupler section 11 at the other end. The female coupler section 10 of each extension shaft 8 is formed in the same manner as that on the starter section 2 of the helical pier 1, i.e., hot forged and compressed to have an increased integral wall thickness that is substantially stronger than conventional hot or cold forged pipe couplings formed merely by swelling the pipe ends. Here again, the entire body section 9 and integral female coupler 10 of the extension shaft 8 is heat treated subsequent to the hot forging process to a yield and tensile strength which meets or exceeds preferably 95,000 psi.

Figure 5A:
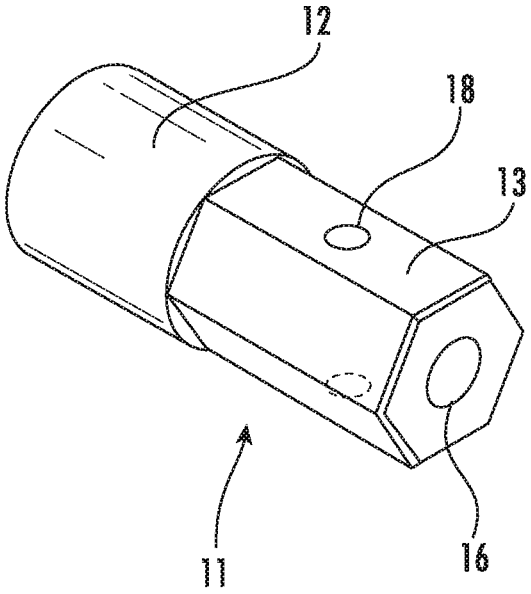
FIG. 5A is a close-up perspective view of the hexagonal male coupler section depicted in FIG. 4, showing the construction thereof.
Figure 5B:
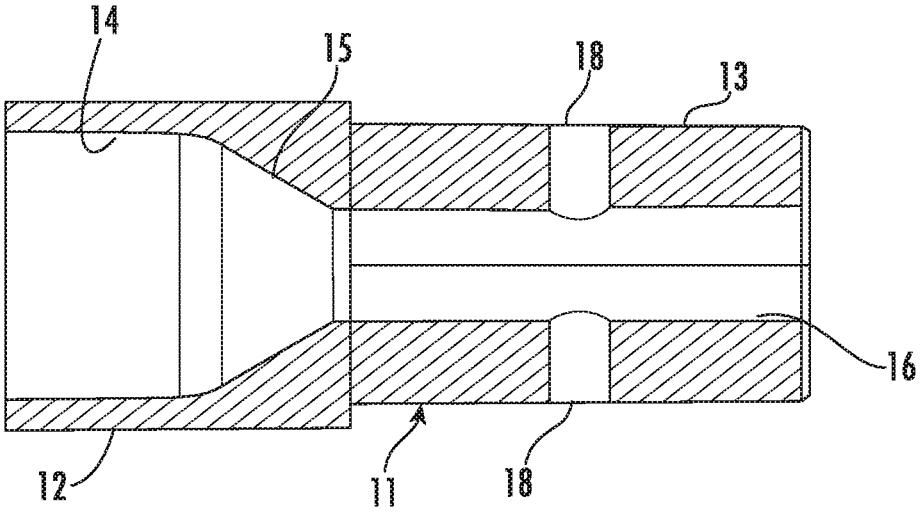
FIG. 5B is a close-up vertically sectioned view of the male coupler section shown in FIG. 5A.
Figure 6:
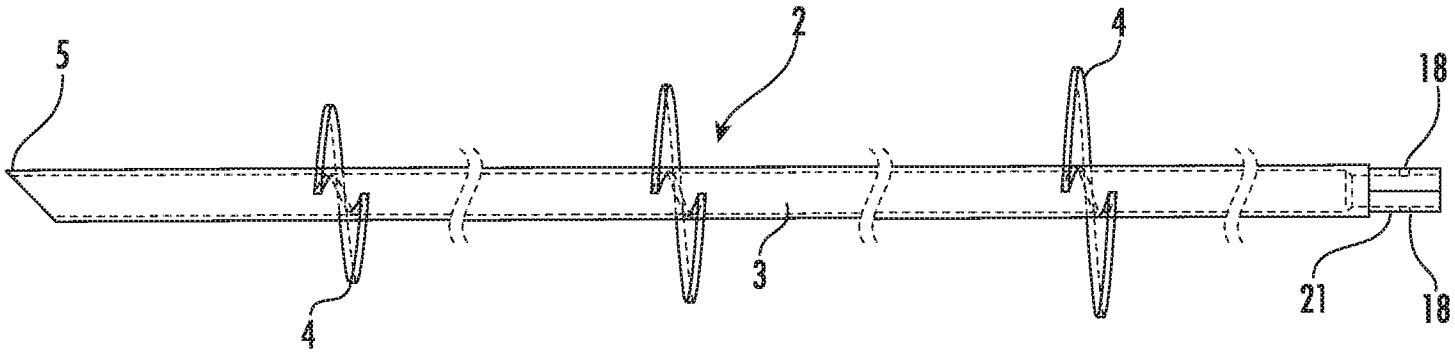
FIG. 6 is a side elevational view of an alternative embodiment of the starter section of a helical pier similar to that shown in FIG. 2, but showing a hot forged integral hexagonal male coupler section instead of a female coupler section formed on one end thereof.
Figure 7A:
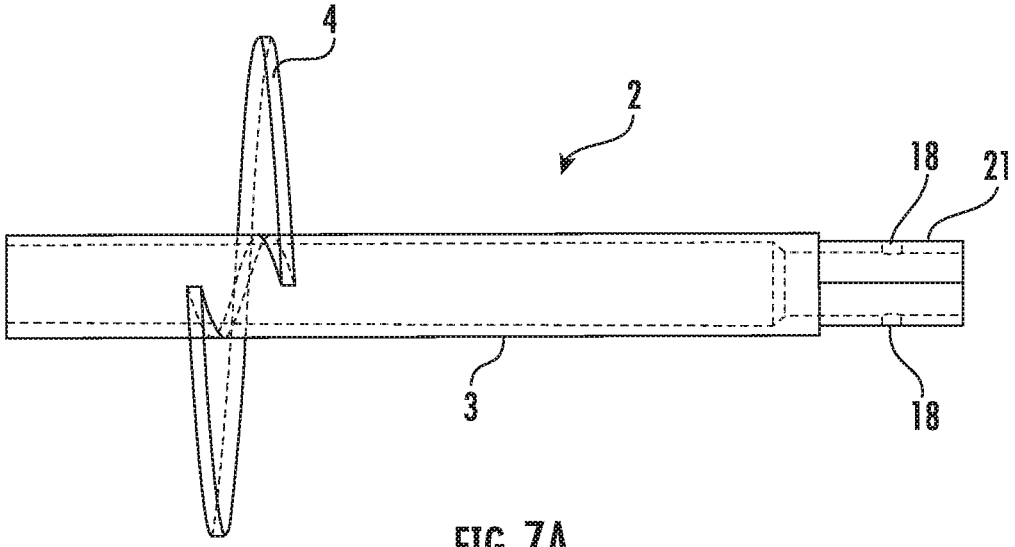
FIG. 7A is a close-up sectional view of the hot forged integral hexagonal male coupler section formed on the end of the starter section shown in FIG. 6.
Figure 7B:
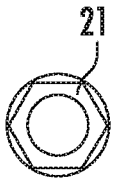
FIG. 7B is an end view of the hot forged male coupler section shown in FIG. 7A, showing the hexagonal configuration of the outer surface thereof.

As best seen in FIGS. 4, 5A and 5B, in one embodiment, it is contemplated that the corresponding male coupler section 11 on the opposite end of extension shaft 8 be independently manufactured and inertia friction welded thereto. As shown, the male coupler section 11 in this embodiment is comprised of a cylindrically shaped base section 12 with a thickened integral hexagonally shaped end section 13. The male coupler 11 is preferably constructed from either heavy wall mild steel tube or mild steel bar, and all drilling and formation of the hexagonal end section 13 is accomplished using a computer numeric control (CNC) milling machine. Use of a CNC milling machine to form coupler 11 permits precise computer-controlled drilling and cutting operations in multiple directions, thus eliminating the need for multiple separate milling operations.

As further shown in FIGS. 4, 5A and 5B, the interior of base section 12 along terminal area 14 is milled to an inner diameter which corresponds substantially to that of extension shaft 8 to which it is connected. Along interior area 15 of base section 12, the milled interior tapers to a lesser diameter so as to become coextensive with the bore 16 extending through the thickened walls of the hexagonal end section 13 of male coupler 11. The exterior hexagonal surface configuration of end section 13 is milled to dimensions just slightly less than the interior dimensions of the corresponding female coupler sections 6 and 10. This facilitates insertion of the male coupler section 11 into the female coupler 6 of the starter section 2, or into the female coupler 10 of another extension shaft 8, as so desired or necessary.

As noted above, upon completing the manufacture of male coupler section 11, it is integrally attached via inertia friction welding to the end 9A of the main tubular body 9 opposite that of female coupler 10. As such, the tubular main body section 9 of extension shaft 8 and the male coupler section 11 become integrally fused together as a single unit at point 9A, thereby completing the extension shaft 8. As best seen in FIG. 4, the walls of the hexagonal end section 13 are substantially thicker than that of the main body section 9 of extension shaft 8. This helps strengthen and further enhance the durability of the coupling joint between the male coupler section 11 and female coupler sections 6 and 10.

By hot forging with compression and heat treating the female hex coupler from the body of each extension shaft, and subsequently inertia friction welding a male hex coupler thereto, a stronger coupling joint can be manufactured through a simplified process. This is contrary to the manufacture of most conventional helical piers, where out-of-round coupling sections are either cold forged, resulting in thinner, weaker coupling joints, or hand welded in order to attach a female coupler having thicker, stronger wall sections. With this embodiment of the present invention, using such hot forging/compression techniques for the hexagonal female coupler simplifies the overall manufacturing process, leaving only a single required inertia welding operation to attach the hexagonal male coupler and complete the process. This not only improves production efficiency, but enhances the strength and durability of the helical pier 1. Thus, heretofore, either strength and durability was compromised in the interest of production efficiency, or production efficiency was compromised in the interest of obtaining stronger and more durable coupling joints. Such compromises are not necessary using the present method of manufacturing.

While not described in detail herein, it is certainly conceivable that a milled hexagonal male coupling section 11, as disclosed above, could be independently manufactured and inertia friction welded to the end of the helical pier drive shaft 3 of the starter section 2, rather than a female coupling section 6. In this case, any extension shaft 8 would simply be reversed to permit the female coupling section 10 thereof to mate with the terminal male coupling section 11 affixed to the drive shaft 3 of the helical pier 1.

With reference now being made to FIGS. 6-8C, an alternative embodiment of helical pier 1 is disclosed which incorporates hexagonally shaped complimentary integral male and female couplers, and requires no welded joints to manufacture. As shown best in FIGS. 6,7A and 7B, with this embodiment, the starter section 2 of helical pier 1 may alternatively be fabricated with a forged integral male coupler section 21, rather than female coupler section 6. In this case, the male end coupler section 21, similar to the female coupler 6, can be formed through a hot forging process of the main drive shaft 3. The upper end portion of the drive shaft 3 can be heated to a moldable state and then internally upset to form the integral male coupler 21. During this process, the male coupler section 21 may be formed with a hexagonal exterior cross-sectional configuration that is sized to mate with an associated female hexagonal coupler 10 of an adjoining extension shaft 8. Similar to its counterpart female coupler section 6, formation of this male coupler section 21 of drive shaft 3 in an out-of-round hexagonal shape substantially strengthens the coupling joint by causing applied torque to the shaft 3 to be transmitted through the entire body of the coupler. Here again, to further enhance the strength and durability of the helical pier 1 well beyond that of any conventional pier device, upon completion of the hot forging process, the entire body section 3 and integral male coupler 21 would be subjected to an additional heat treatment process which effectively increases the yield and tensile strength thereof to meet or exceed preferably 95,000 psi.

Figure 8A:
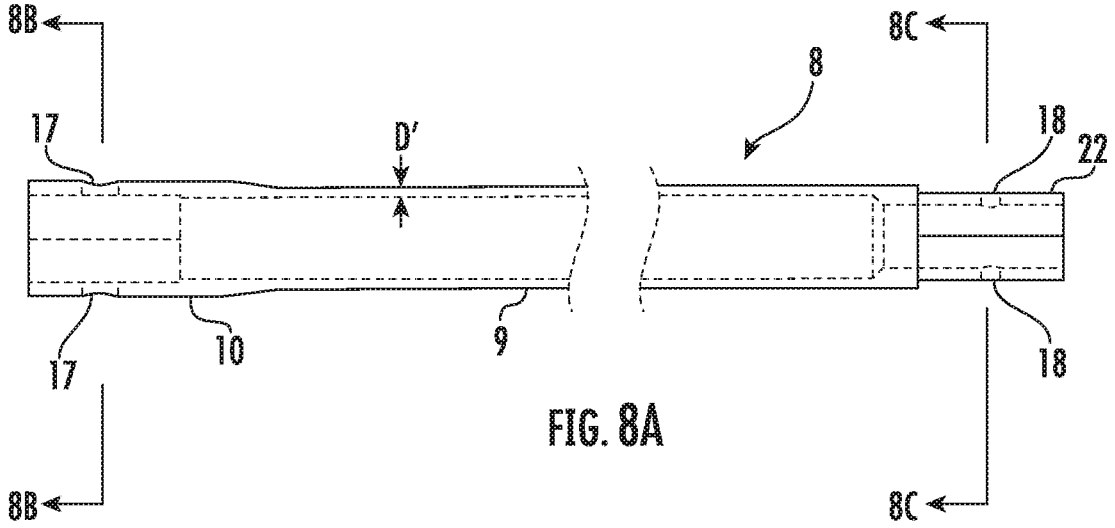
FIG. 8A is a vertically sectioned side elevational view of another alternative embodiment of an extension shaft, showing hot forged integral hexagonal female and male coupler sections formed on opposite ends thereof.
Figure 8B:
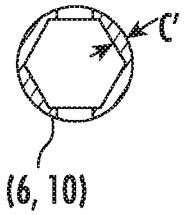
FIG. 8B is a vertical section taken along lines 8B-8B of the hot forged female coupler section shown in FIG. 8A.
Figure 8C:
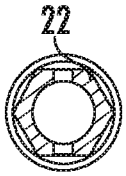
FIG. 8C is a vertical section taken along lines 8C-8C of the hot forged male coupler section shown in FIG. 8A.

As shown in FIGS. 8A-8C, in a similar manner, extension shaft 8 can be manufactured as a weldless unit by hot forging a male coupler section 22 integrally from the same body portion 9 thereof, rather than inertia friction welding the coupler. In this case, both the female and male coupler sections 10 and 22, respectively, would be integrally formed with the main body section 9 of the extension shaft 8 as a single homogeneous structure, i.e., no welds. The male coupler section 22 can be forged and internally upset to provide a hexagonal outer configuration that will mate with the inner hexagonal configuration of a corresponding female coupler section (6, 10) of an adjoining starter section 2 or extension shaft 8. Through this process of hot forging and compression, the walls of both the female coupler section 10 and male coupler section 22 will become thickened relative to the main body section 9, thereby increasing the overall strength of the extension shaft. Here again, the entire extension shaft 8, including the body section 9, and the integral female and male coupler sections 10 and 22, may be heat treated subsequent to the hot forging process to a yield and tensile strength which meets or exceeds preferably 95,000 psi.

In order to facilitate the attachment of a torque driving apparatus (not shown), or additional extension shafts 8, at least one set of opposing hexagonal faces of the female couplers (6, 10) includes pre-drilled holes 17 extending transversely through its wall from the exterior to the interior of the coupler (6, 10). Similar to the female coupler section, the corresponding male hexagonal coupler section of each extension shaft 8 (or drive shaft 3) has corresponding pre-drilled tapped holes 18 extending through the walls of at least one set of opposing hexagonal faces thereof, which are configured and positioned to align with the holes 17 of the female coupler sections (6, 10) to facilitate securement therebetween. Bolts (not shown) received through the openings of the female coupler sections (6, 10) may be threaded into the aligned tapped holes 18 of the male coupler 11 to secure the adjoining shafts together.

Figure 9:
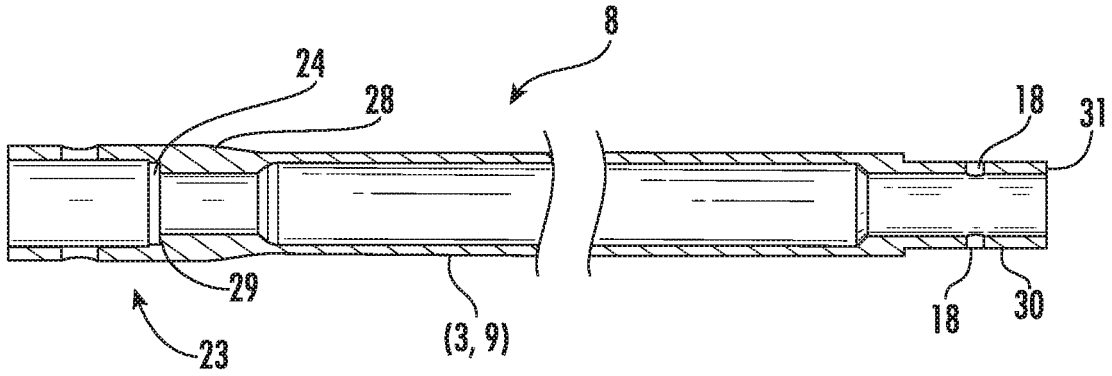
FIG. 9 is a vertically sectioned side elevational view of a helical pier extension shaft similar to that shown in FIG. 8A, showing and alternative hot forged integral hexagonal female coupler section formed on one end thereof which is adapted to receive a sealing ring for use in a grouted helical pier system.
Figure 10:
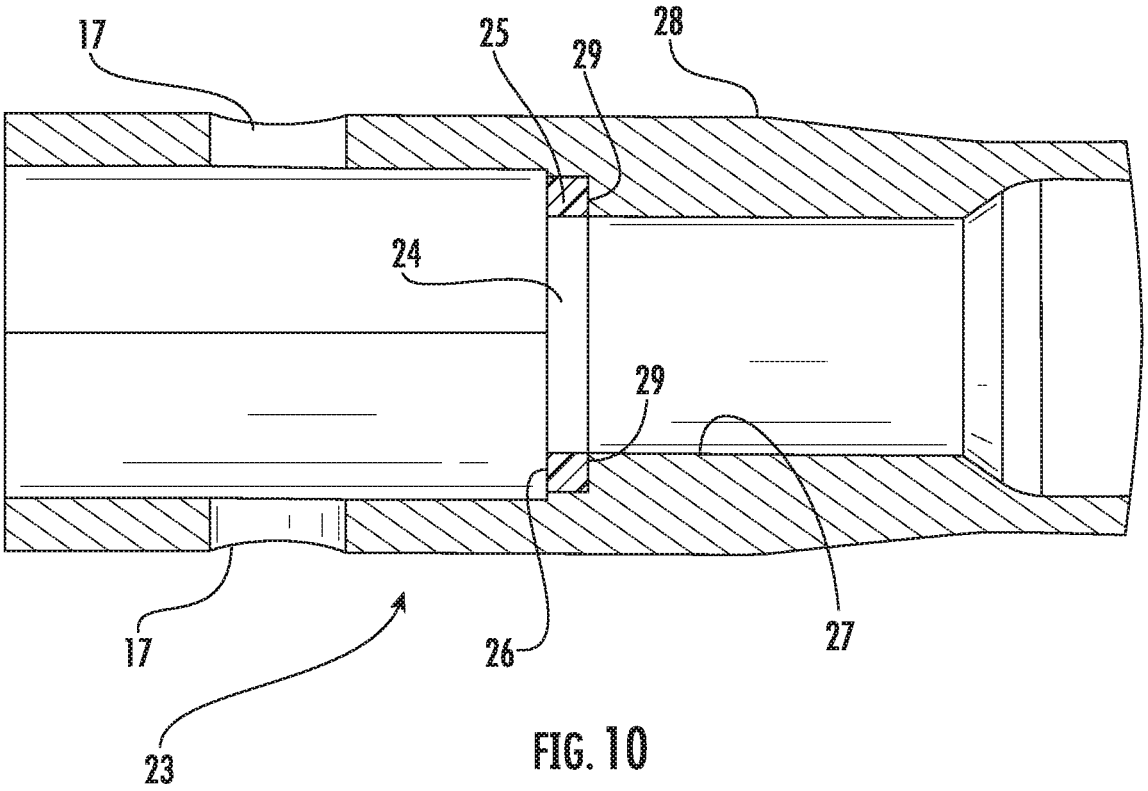
FIG. 10 is a close-up sectional view of the alternative hot forged hexagonal female coupler section shown in FIG. 9, with the sealing ring shown installed therein.
Figure 11:
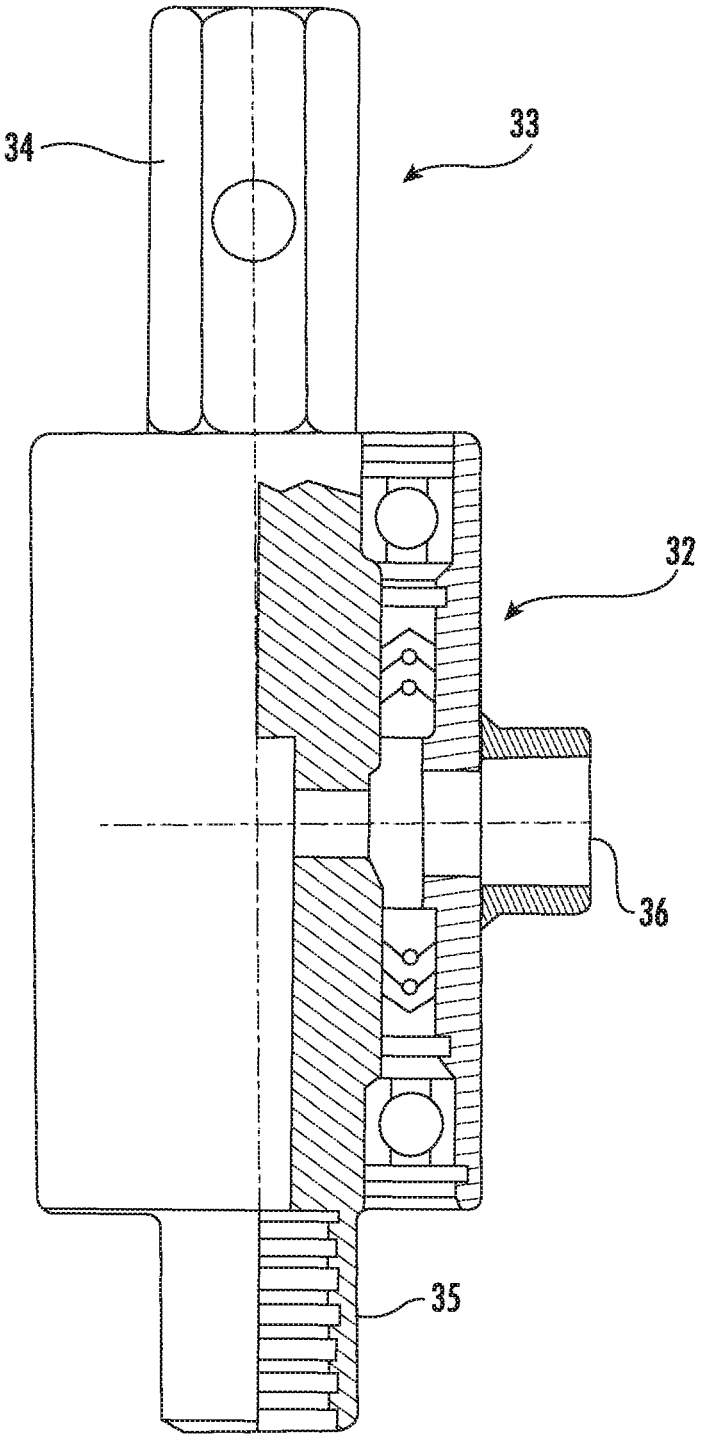
FIG. 11 is a partial sectional view of an inlet swivel used in connection with a grouted helical pier system to introduce grout through the helical pier and into the surrounding soil as it is being driven into the ground.

With reference now to FIGS. 9-11, it is evident that the foregoing technology can also be adapted for use in connection with grouted helical pier systems. With a grouted pier system, grout (i.e., cement) is forced under pressure through the interior of the starter section 2 (and extension shafts 8) to the bottom of the pier. As the grout is pushed through the shaft(s), it exits through openings in the shaft sidewall (not shown). Consequently, as the helical pier 1 is driven into the ground, the grout is imbedded in the area surrounding the pier, thus forming a column of grout around the pier 1 from the ground surface to the installed depth. Imbedding grout in this manner increases skin friction on pier 1, thus adding to the capacity and lateral load of the pier 1.

Few modifications are necessary to the forgoing pier sections 1 to accommodate use in a grouted pier system. As can be seen from FIGS. 9 and 10, the basic starter section 2 and extension shaft 8 may be constructed in a similar manner as described in previous embodiments, with the exception that the hexagonally shaped female end coupler section 23 of a grouted helical pier is formed with an added seal chamber 24. Seal chamber 24 is adapted to receive a sealing ring 25 (FIG. 10) for allowing pressurization of fluids and controlling leakage of grout caused by back pressure within the system when the grout is forced through the tubular shaft(s) of the pier.

As shown in FIG. 10, the sealing ring 25 is circular in configuration and has an inner diameter that coincides substantially with the inner diameter 27 of the transitional pipe section 28 connected to the female coupler section 23. As seen, the chamber or cavity 24 within which sealing ring 25 is to be seated is located directly between the transitional section 28 and the inner distal end 26 of the hexagonally shaped portion of female coupler section 23. The transitional section 28 is integrated through the hot forging process with the female coupler section 23 and the main tubular body section (3, 9) of the starter or extension shaft with which it is formed. The seal chamber 24 within the female coupler section 23 provides a solid shoulder 29 upon which sealing ring 25 may be seated for a sealed connection with an adjoining male hexagonal male coupler section 30. The sealing ring 25 may be made of any suitable sealing material, including without limitation, a plastic material, such as urethane.

As seen from FIG. 9, the opposite male coupler section 30 and modified female coupler section 23 are formed in a complimentary hexagonal shape to mate with one another, such that the end 31 of an adjoining male coupler section 30 will bear against the seal 25 seated within the seal chamber 24 of female coupler section 23. As with prior embodiments, the corresponding hexagonally shaped male coupler 30 may be milled and inertia friction welded to the starter section 2 or extension shaft 8 of the helical pier 1, or alternatively hot forged and internally upset as an integral homogeneous part thereof.

As shown in FIG. 11, in order to introduce grout into the system and force it through the respective interior tubular body sections (3, 9) of the starter section 2 and extension shafts 8, a conventional side inlet swivel 32 may be connected to a rotary head 33 above the inlet swivel 32, and to the helical pier 1 below it. A hexagonal male coupler section 34 could be used with head 33 above the inlet swivel 32, and a similar hexagonal male coupler 35 could be used on the bottom to connect to a hexagonal female coupler 23 of a starter section 2 or extension shaft 8. If needed, a female hexagonal coupler could also be used. With the inlet swivel 32, grout can be introduced into the string of pipe through side inlet port 36 as the helical pier 1 is being driven into the ground, thus effectively forcing the grout through the pier and into the surrounding earth to further strength the soil base for the pier.

As with previous embodiments, in order to facilitate the attachment of a torque driving apparatus (not shown), or additional extension shafts 8, at least one set of opposing hexagonal faces of the female coupler 23 includes pre-drilled holes 17 extending transversely through its wall from the exterior to the interior of the coupler 23. Similar to the female coupler section 23, the corresponding male hexagonal coupler section 30 of each extension shaft 8 of the grouted helical pier system has corresponding pre-drilled tapped holes 18 extending through the walls of at least one set of opposing hexagonal faces thereof. These tapped holes 18 are configured and positioned to align with the holes 17 of the female coupler section 23 to facilitate securement of the male coupler section 30 in substantially sealed relation with the female coupler section 23. Bolts (not shown) received through the openings of the female coupler section 23 may be threaded into the aligned tapped holes 18 of the male coupler section 30 to secure the adjoining shafts together in sealed relation.

It is worth noting that one additional advantage to forming the female and male coupler sections using a process of hot forging and compression of the starter and extension shafts is that the material required to manufacture the above-mentioned securing bolts can be gathered from the shaft sections during the forging process. With such recovery of material, there would be no need to provide additional tool joint material to produce the bolts, thus adding to the potential cost savings of conventional systems. Accordingly, using the processes and principles of the invention described herein will not only produce a stronger, more durable and viable product, but it will also result in substantial savings in time and production efficiency.

It will, of course, be understood that various changes may be made in the form, details, arrangement and proportions of the parts without departing from the scope of the invention which comprises the matter shown and described herein and set forth in the appended claims.

The invention claimed is:

1. A drive shaft for a helical pier, comprising:

(a) a tubular main shaft section being formed with an initial yield and tensile strength, and having opposite ends and a cylindrical shaft wall formed about a general axis of symmetry;

(b) a terminal coupling section being hot forged homogeneously from one of said opposite ends of said main shaft section, said coupling section having a coupling wall with a hexagonal cross-sectional configuration;

(c) said terminal coupling section being compressed axially along said axis of symmetry during formation to increase the thickness of at least a portion of said hexagonally shaped coupling wall relative to the thickness of said cylindrical shaft wall of said main shaft section; and (d) the entirety of said main shaft section and said compressed terminal coupling section being heat treated to a yield and tensile strength greater than said initial yield and tensile strength of said main shaft section.

2. The drive shaft of claim 1, wherein said coupling section is a female coupler having an inner wall surface which defines said hexagonal cross-sectional configuration of said coupling wall.

3. The drive shaft of claim 1, wherein said coupling section is a male coupler having an outer wall surface which defines said hexagonal cross-sectional configuration of said coupling wall.

4. The drive shaft of claim 1, wherein a pair of said terminal coupling sections are formed one each on said opposite ends of said main shaft section, one of said coupling sections comprising a female coupler having an inner wall surface which defines said hexagonal cross-sectional configuration of its said coupling wall, and said coupling section formed on said opposite end of said main shaft section comprising a male coupler having an outer wall surface which defines said hexagonal cross-sectional configuration of its said coupling wall.

5. The drive shaft of claim 1, wherein said coupling section on one of said opposite ends of said main shaft section is a female coupler having an inner wall surface which defines said hexagonal cross-sectional configuration of said coupling wall, and the other of said opposite ends of said main shaft section carries an inertia friction welded male coupler having an exterior hexagonal configuration which is complimentary to and constructed to mate with said female coupling section of another drive shaft.

6. The drive shaft of claim 5, wherein said male coupler is comprised of an independently milled tubular section of pipe having a wall thickness which is greater than the thickness of said cylindrical shaft wall of said main shaft section.

7. The drive shaft of claim 1, wherein said main shaft section and said terminal coupling section have a carbon composition of at least about 0.25% by weight.

8. The drive shaft of claim 1, wherein said main shaft section and said terminal coupling section are heat treated to a yield and tensile strength of at least 95,000 pounds per square inch.

9. The drive shaft of claim 1, wherein said coupling section is a female coupler having an inner wall surface which defines said hexagonal cross-sectional configuration of said coupling wall, and an outer wall surface that is cylindrical in cross section.

10. The drive shaft of claim 9, wherein said terminal coupling section is swedged outwardly, and compressed such that a thickness between said inner hexagonally shaped wall surface and said outer cylindrical wall surface thereof is greater than the thickness of said cylindrical shaft wall of said main shaft section.

11. The drive shaft of claim 1, wherein said coupling section is a male coupler having an inner cylindrical wall surface and an outer wall surface which defines said hexagonal cross-sectional configuration of said coupling wall.

12. The drive shaft of claim 11, wherein said terminal coupling section is heated, internally upset and compressed to form said male coupler as an integral homogeneous unit with said main shaft section, where a thickness between said inner cylindrical wall surface and said outer hexagonally shaped wall surface thereof is greater than the thickness of said cylindrical shaft wall of said main shaft section.

13. The drive shaft of claim 1, wherein said main shaft section carries a plurality of fixed, axially spaced helically shaped flights on an outer surface thereof.

14. The drive shaft of claim 1, wherein said coupling section is a female coupler having an inner wall surface which defines said hexagonal cross-sectional configuration of said coupling wall, said coupling section including an interior cavity disposed adjacent an end of said inner wall surface for carrying a sealing ring.

15. A drive shaft for a helical pier, comprising:

(a) a tubular main shaft section being formed with an initial yield and tensile strength, and having opposite ends and a cylindrical shaft wall formed about a general axis of symmetry;

(b) a female terminal coupling section being hot forged homogeneously from one of said opposite ends of said main shaft section, and being swedged outwardly to form a tubular coupling wall with an interior wall surface that is hexagonally shaped in cross section;

(c) a male terminal coupling section being hot forged homogeneously from the other of said opposite ends of said main shaft section, and being internally upset to form a tubular coupling wall with an exterior wall surface that is hexagonally shaped in cross section;

(c) said female and said male terminal coupling sections being compressed axially along said axis of symmetry during formation to increase the thickness of at least a portion of each of said hexagonally shaped coupling walls relative to the thickness of said cylindrical shaft wall of said main shaft section; and (d) the entirety of said tubular main shaft section, said female terminal coupling section and said male terminal coupling section being heat treated to a yield and tensile strength which meets or exceeds 95,000 psi.

16. A method of forming a drive shaft for a helical anchor, comprising the steps of:

(a) providing a tubular main shaft section formed of steel, said main shaft section being formed with an initial yield and tensile strength, and having opposite ends and a cylindrical shaft wall formed about a general axis of symmetry;

(b) hot forging a terminal coupling section homogeneously from one of said opposite ends of said main shaft section, said coupling section be formed with a coupling wall that has a hexagonal cross-sectional configuration;

(c) compressing said terminal coupling section axially along said axis of symmetry to increase the thickness of at least a portion of said hexagonally shaped coupling wall relative to the thickness of said cylindrical shaft wall of said main shaft section; and (d) heat treating the entirety of said main shaft section and said compressed terminal coupling section to a yield and tensile strength which is greater than said initial yield and tensile strength of said main shaft section.

17. The method of forming a drive shaft of claim 16, wherein said step of hot forging said terminal coupling includes swedging one of said opposite ends of said tubular main shaft section outwardly to form a female coupler having an inner wall surface which defines said hexagonal cross-sectional configuration of said coupling wall, and an outer wall surface that is cylindrical in cross section.

18. The method of forming a drive shaft of claim 16, wherein said step of hot forging said terminal coupling includes internally upsetting one of said opposite ends of said tubular main shaft section to form a male coupler having an outer wall surface which defines said hexagonal cross-sectional configuration of said coupling wall, and an inner wall surface that is cylindrical in cross section.

19. The method of forming a drive shaft of claim 16, including the following steps:

(d) swedging said hot forged end of said tubular main shaft section outwardly to form a female coupler having an inner wall surface which defines said hexagonal cross-sectional configuration of said coupling wall; and (e) inertia friction welding an independently milled male coupler to the other said end of said main shaft section, said male coupler having an exterior hexagonal configuration which is complimentary to and constructed to mate with said female coupler of another drive shaft.

* * * * *